US005384942A

United States Patent [19]

Siegel

[11] Patent Number: 5,384,942

[45] Date of Patent: Jan. 31, 1995

[54] CLOSURE DEVICE FOR BAGS AND A METHOD AND A TOOL FOR PRODUCING SAME

[75] Inventor: Karl-Heinz Siegel, Nurnberg, Germany

[73] Assignee: Minigrip, Inc., Orangeburg, N.Y.

[21] Appl. No.: 148,173

[22] Filed: Nov. 4, 1993

Related U.S. Application Data

[63] Continuation of Ser. No. 969,527, Oct. 30, 1992, abandoned, which is a continuation of Ser. No. 609,978, Nov. 6, 1990, abandoned.

[30] Foreign Application Priority Data

Nov. 7, 1989 [DE] Germany ..... 3937088

[51] Int. Cl.[6] ..... B65D 33/16

[52] U.S. Cl. ..... 24/587

[58] Field of Search ..... 24/587, 399, 400; 383/63, 65

[56] References Cited

U.S. PATENT DOCUMENTS

| | | | |
|---|---|---|---|
| 4,354,541 | 10/1982 | Tilman | 24/587 X |
| 4,363,345 | 12/1982 | Scheibner | 24/587 X |
| 4,701,358 | 10/1987 | Behr . | |
| 4,812,056 | 3/1989 | Zieke | 24/587 X |
| 4,898,492 | 2/1990 | Janowski . | |
| 4,929,487 | 5/1990 | Tilman et al. | 24/587 X |
| 5,209,574 | 5/1993 | Tilman | 24/587 |

FOREIGN PATENT DOCUMENTS

| | | | |
|---|---|---|---|
| 764647 | 8/1967 | Canada | 24/587 |
| 155612 | 9/1985 | European Pat. Off. . | |
| 241334 | 10/1987 | European Pat. Off. . | |
| 1493748 | 9/1967 | France . | |
| 2620377 | 3/1989 | France . | |
| 2036432 | 2/1971 | Germany . | |
| 3032889 | 10/1981 | Germany . | |
| 1156170 | 6/1969 | United Kingdom . | |
| 1326945 | 8/1973 | United Kingdom . | |

*Primary Examiner*—James R. Brittain

*Attorney, Agent, or Firm*—Kane, Dalsimer, Sullivan, Kurucz, Levy, Eisele and Richard

[57] ABSTRACT

A closure device, preferably made of plastic, serves for closing bags. It consists of a male section (1) and a female (2, 5 and 6), which are respectively joined to film (3 and 4) and may be detachably connected together. In order to ensure that such a closure device may be readily closed while at the same time being simple and cheap to produce, at least two spaced continuous projections (8) are provided on the side of the film (3) opposite to the male section (1). Similar projections (9) may advantageously be placed on the opposite side of the female section.

16 Claims, 4 Drawing Sheets

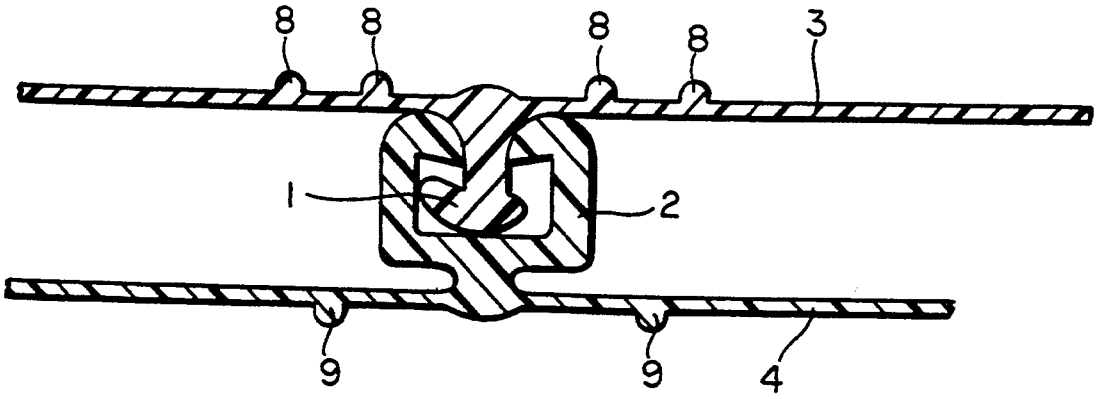
FIG. 4
FIG. 5
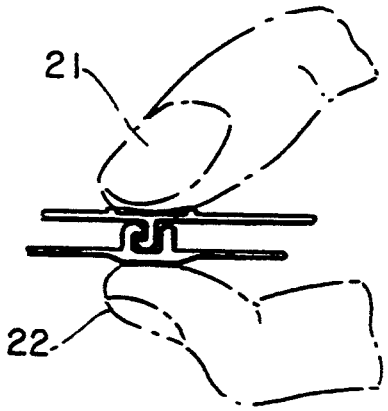

CLOSURE DEVICE FOR BAGS AND A METHOD AND A TOOL FOR PRODUCING SAME

This application is a continuation of application Ser. No. 07/969,527 filed Oct. 30, 1992, now abandoned which is a continuation of application Ser. No. 07/609,978, filed Nov. 6, 1990, now abandoned.

BACKGROUND AND OBJECTS OF THE INVENTION

The invention relates to a closure device, preferably made of plastic, for bags, comprising a male extruded section and a female extruded section, which are connected with film and are adapted to be detachably connected with each other. The invention furthermore relates to a bag, preferably made of plastic, a method for the production of a closure device or a bag and a tool for the production of a closure device or a bag.

Known closure devices for bags of the aforesaid type, which may be co-extruded with the film from a tubular dye, are described in the German patent publication 1,486,627 C and 1,950,724 C. As another example, U.S. Pat. No. 4,263,079 describes a closure device which is extruded from a dye onto prefabricated film. It is also possible to extrude the closure i a device by itself from a dye and then to connect it with a film by welding or bonding.

Heretofore, a principal preoccupation in the art has been to produce closure devices with the smallest possible dimensions, in order to save material and to allow easier transverse welding on bag making machines, since any reinforcement of the closure device part will mean that in later hot cutting, in the course of which bags are produced from the film with the closure, the welding operation will be impeded or additional plant will be called for.

One disadvantage of known closure devices is that the male section or rib (i.e., the projecting hook), can be very readily displaced to the side so that a user who is not familiar with such a closure device or bag will frequently have difficulties when closing the closure device or the bag fitted therewith. It has been seen that such closure devices or bags fitted therewith and which are intended to be reusable so that the contents—more particularly in supermarkets and small stores—may be sealed off, are not always reclosable so that there is a chance of the contents deteriorating simply because the bag has been opened once. It is only seldom the case that a user is able to readily shut the narrow, thin single groove closure devices of the foregoing type.

In the case of the aforesaid known closure devices, the female section which is to accept the male section, is stiffer owing to the necessarily reinforced back so that any attempt to close the known closure device or the bag therewith without starting at one of the edges will simply result in the male section, (i.e., the single hook,) slipping to the side too easily so that an inexperienced user is not able to introduce the single hook precisely into the female section.

The European patent publication 114,373 A describes a design in which the male section is stiffened by having ribs, which extend in the same direction as the male section and are spaced therefrom. The ribs are placed on different sides of the male section and point in the same direction as it does. This closure device suffers from the disadvantage that a substantially greater amount of material is required, this being due to the comparatively large ribs and the additionally required reinforced back. The ribs are essentially of the same size as the male section. These features taken together also have a disadvantageous effect on the costs of production and furthermore are a potential disadvantage for the environment owing to the need to dispose of the closure device when no longer required. Furthermore the production of the tools is more difficult since a relatively complex matching of the respective dyes (i.e., extrusion dyes) is needed.

The European patent publication 223,125 A describes a device in the case of which two fins are arranged on the left and the right of the male section, and which point in the same direction as the male section. However, the thickness of the back of the section is reduced. The fins however mean that substantially more material is required than is the case with the projections as proposed in the present invention. A further drawback with the design in accordance with tile said European patent publication 223,125 A is that upon pressing the two section parts together and running one's fingers along it to close the section, the user will only be able to detect the slightly higher part with his thumb, such higher part being provided under the male section and which is not able to be avoided for rheological reasons. The guiding action for the thumb on closing the section is thus poor.

It is, therefore, an object of the invention is to provide an improved device of the aforesaid type which may be readily closed while being able to be simply and cheaply produced.

SUMMARY OF THE INVENTION

In accordance with the invention this object is attained by arranging at least two continuous spaced projections on tile side of the film remote from the male section. The projections, which are small in relation to tile section, are arranged on the back part of the male section so that they are directed in the opposite direction to the direction in which the male section is pointed. Since tile projections are comparatively small in size, only a very small amount of material is required for their manufacture and this means that the closure device is able to be produced relatively inexpensively. The projections may be applied in a simple manner. The closure device is simple to close or fasten, since the projections involve a very satisfactory guiding action.

In contrast with prior an approaches, the projections of the present invention provide a much better guiding action for the thumb when closing the section. The projections stabilize the male section to a sufficient extent so that the end user is not only able to more readily close the closure device from the edge of the bag, but is also able to cause engagement of the closure ribs starting at any desired point in the middle of the bag or, respectively, of the closure device.

A further substantial beneficial effect of the projections is that they are on the back of the section, that is to say on the outer side of the closure device, or respectively, of the bag. The male section and the projections thus point in opposite directions. This configuration has the advantage that after pressing together the section parts for the first time and engaging them and then running the thumb and index finger along the closure device, the user will be able to sense a distinct guiding action with his thumb owing to the projections and will thus automatically guide the male section straight ah cad on pinching the closure device to close it. This leads to a simple but nevertheless considerably improved design which avoids the disadvantages described herein, while still ensuring easy and reliable closure of the parts of the closure device. All this is possible with the very least requirement for material.

It is also possible to provide two continuous projections with the invention. This means it is possible to ensure sufficient stabilization with a minimum requirement tier material. In certain applications it is an advantage if four continuous projections are provided, since in this case one may expect a greater stabilizing or stiffening effect.

It is possible to have at least two spaced continuous projections on the side of the other film turned away from the female section.

It is preferred to have one, several or all the projections colored. Such colored projections thus provide a readily apparent aid when closing the device.

The invention furthermore provides a bag, preferably of plastic, which is characterized by a closure device of the above-mentioned type. The closure device is preferably made integrally with the bag.

The invention also provides a method for the production of a closure device and a bag of the type indicated. In accordance with the invention the films and the projections or, respectively, the bag and the closure device are extruded in a single working operation from a single tool. In this respect it is possible to extrude one or more of the projections in a colored form. The method used in order to apply the projections constitutes a further advantage over the known closure devices. Since the projections are applied to the rear of the section. That is to say opposite to the direction of the section, it is possible for the section extruding dye to be made without any undesired effects thereon. While in the method in accordance with European patent publication 114,373 A or the European patent publication 223,125 A in respect of the dyes it is necessary to pay great attention to the rheology and the associated radial forces, caused by the relatively thick parts of the sections and the relatively thin parts of the film, in the present case the projections are produced completely separately from the section as such, either by separate injection molding on the same using an auxiliary extruder, or by causing a suitable flow of material in the outer ring of the dye, same being independent of the closure device section as such.

Accordingly the invention also relates to a tool for the production of a closure device or, respectively, of a bag of the initially mentioned type, consisting of a ring and a core which define an annular gap between them. At a position radially outside the annular gap ducts are provided for the feed of material which produces the projections. Preferably an auxiliary extruder is provided for these ducts. The ducts receive the material necessary for the production of the projections through this auxiliary extruder. The auxiliary extruder may supply colored material so that this presents a particularly simple way of producing colored projections.

BRIEF DESCRIPTION OF THE DRAWINGS

Working examples of the invention will now be described in detail with reference to the accompanying drawings.

FIG. 4 shows still another closure device according to the invention with two further projections on the female part.

FIG. 5 shows a closure device according to the invention in the process of being closed.

DETAILED DESCRIPTION OF PREFERRED EMBODIMENT

Figure 1:
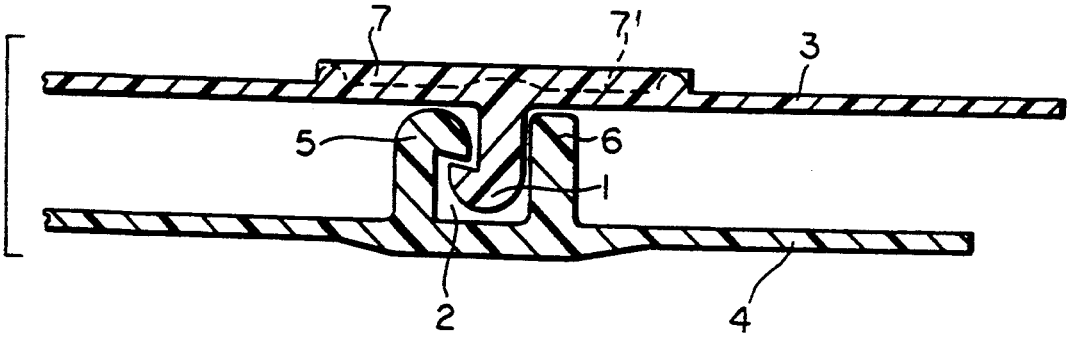
FIG. 1 shows a prior art closure device, but for comparison also illustrates in phantom certain structure according to the present invention.

In the closure device shown in FIG. 1 of known design, the male section 1 is hookingly connected with the female section 2. The female extruded section 2 consists of a hook extruded section 5 and extruded section part 6 without any hook. The hook of the male extruded section 1 is complementary to that of the section part 5 of the female part. The mate extruded section 1 is integrally joined to a film 3 or foil and the female extruded section 2 is integrally joined with the other film 4. On the side of the film 3 opposite to the section the male section 3 has a reinforced back 7. (As will be apparent from the description hereafter, the structure shown in phantom line 7' is not part of the prior art device.)

Figure 2:
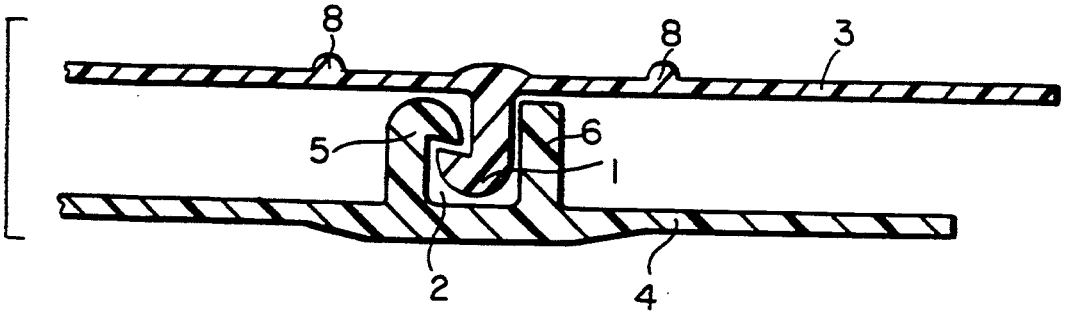
FIG. 2 shows a closure device according to the invention with two projections.

FIG. 2 shows a closure device of plastic or synthetic resin for closing bags, consisting of a male section 1 and a female section 2, which consists of the hook part 5 and the section part 6, both the male section 1 and the female section 2 being connected with a segment of film 3 and 4, respectively. Owing to the hooking interlocking action, the male section and the female section may be detachably joined to each other. On the side of the film 3 remote from the male section there are two spaced continuous projections 8. The projections 8 are integrally connected with the film 3. As will be seen from FIG. 2, the present invention eliminates all the material making up the reinforced back of the prior art device (see FIG. 1) except for that corresponding to projections 8, while the remaining part of the back 7 of the section is attenuated and in substance is not thicker than the film itself. For comparison, the contour of the structure in FIG. 2 is represented by the phantom or broken line 7' in FIG. 1.

Figure 3:
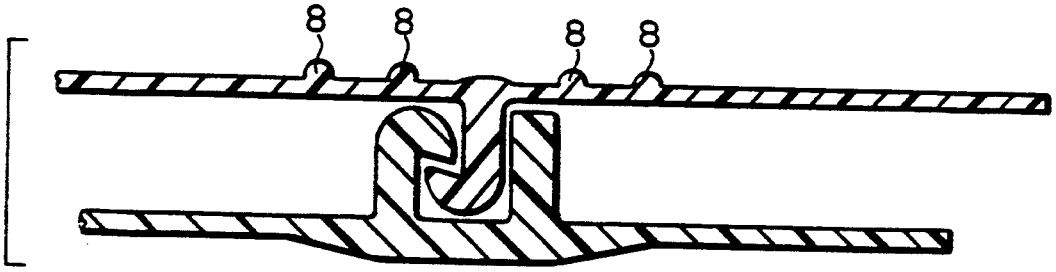
FIG. 3 shows another closure device according to the invention with four projections.

In the illustrated working embodiment of FIG. 3 there are four projections 8 in lieu of two thereof in order to provide for enhanced stabilization of the film, as explained above.

As will be seen from FIG. 4, it is possible to provide a plurality of (here there are 2) continuous spaced projections 9 on the side, remote from the female section 2, of the other piece of film 4, that is to say the film coupled to the female section 2. The projections 8 and 9 are essentially semicircular in cross section. However, other forms of cross section are possible as well.

It will be seen from FIG. 5 how the two projections are engaged by the thumb 21 of the user when closing the closure device. A user will get a pronounced guiding action from the contact with the two raised parts (projections) which will automatically cause the male section to move straight forwards as thumb 21 is run along the closure device. A finger 22, usually the index finger, of tile same hand will be held opposite to the thumb 21.

Figure 6:
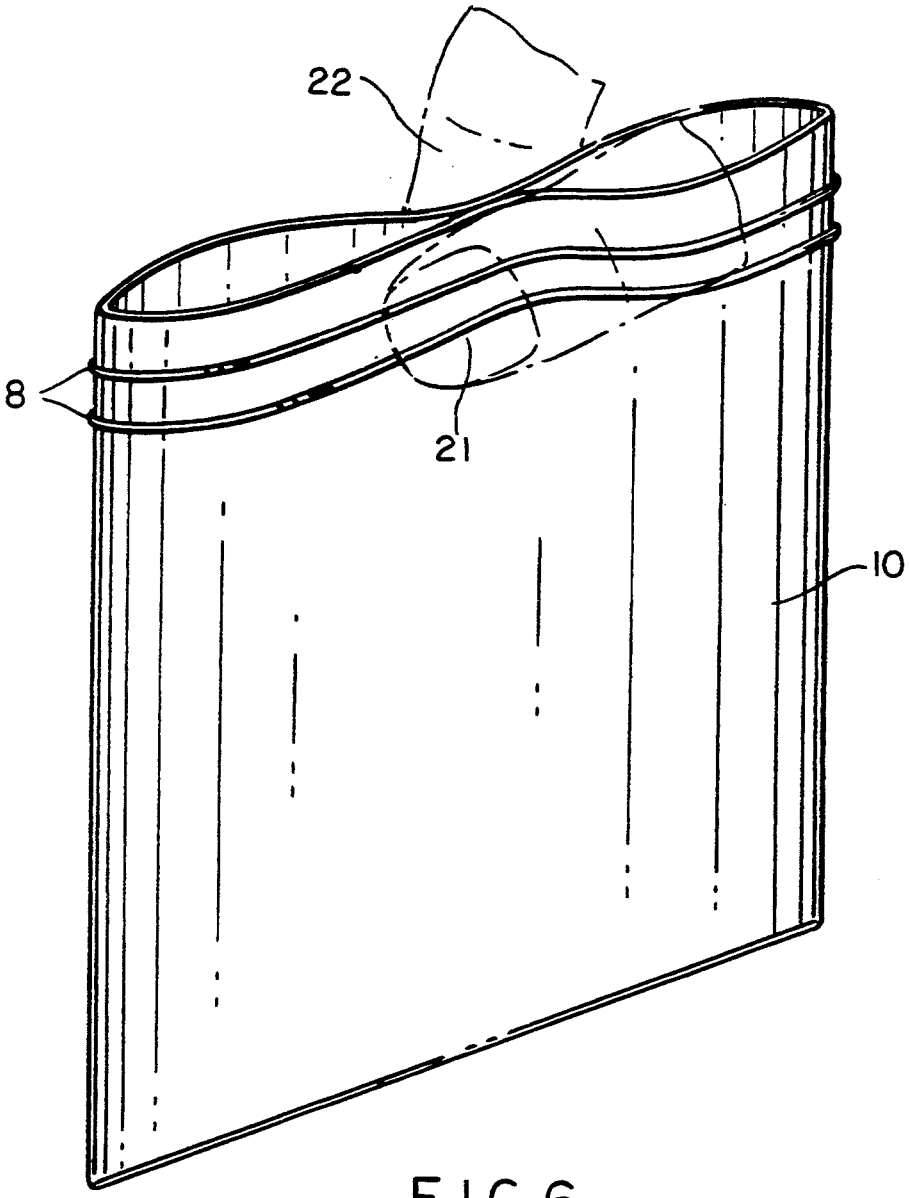
FIG. 6 shows a bag with a closure device, according to the invention, in the process of being closed.

FIG. 6 shows a closable bag 10 of the type described which, owing to the stiffening effect of the projections 8 in the closure part on the upper end of the bag 10, may be closed with the thumb 21 and the index finger 22 starting at the middle by simply pressing together without the parts of the closure device slipping out to the side. The projections 8 in this case have a stiffening action in a manner similar to the considerable stiffening effect that corrugations or ridges have in thin sheet metal. If the male section only consists of a single hook, the same will slip out of the center position when pressing the bag closure device together (as shown in FIG. 6) towards the side and will not engage the female part, if there are no projections. The projections 8 however make it possible to reliably fasten the closure device even starting from the middle, as is shown in FIG. 6.

Stiffening means in the form of ribs have already been proposed in the European patent publication 114,373 A and the European patent publication 223,125 A. However, in these cases, the ribs are always directed in the same direction as the male or female pans on the sections. In the present invention, because the projections 8 and 9, respectively, are pointed in the opposite direction to the associated section, the overall cross section and, respectively, the entire length of the cross section is increased so that the overall stiffness is also increased.

Figure 7:
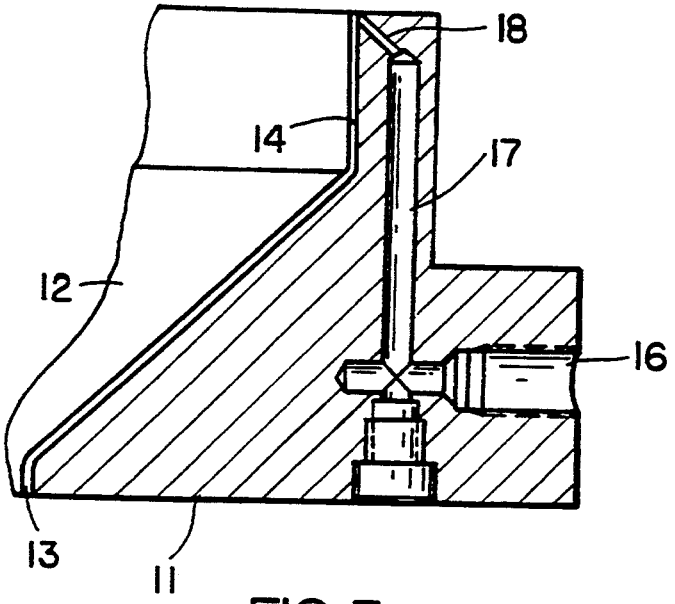
FIGS. 7 and 7A show a tool for the production of a tubular film with integral closure device sections and for molding on the projections by means of an auxiliary extruder.
Figure 7A:
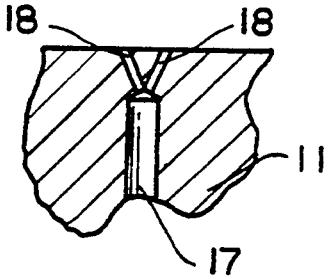

FIG. 7 shows a tool for the extrusion of tubular film with an integral closure device section and for molding the projections using an auxiliary extruder, on the part of the tool being shown in detail, which is used for molding on the projections. The tool consists of a ring 11, which surrounds a core 12. Plastic material flows through the annular duct 13 between the ring 11 and the core 12 from an extruder in an upward direction into the tool. Ultimately the material flows through the narrow gap 14 and thus forms a tubular plastic film or foil. Using an auxiliary extruder, material is caused to flow through the nozzle 16 of the extruder, through a hole 17 and a narrower duct 18 directly onto the upper edge of the ring 11 to form the projection on the emerging plastic tubular film. The duct 18 opens in such a manner into the gap 14 that the projection is formed. As will be seen from the view marked FIG. 7, the hole 17 branches into two ducts 18 in order to form the two projections. If more projections are to be produced, it is possible to have a correspondingly larger number of ducts.

Figure 8:
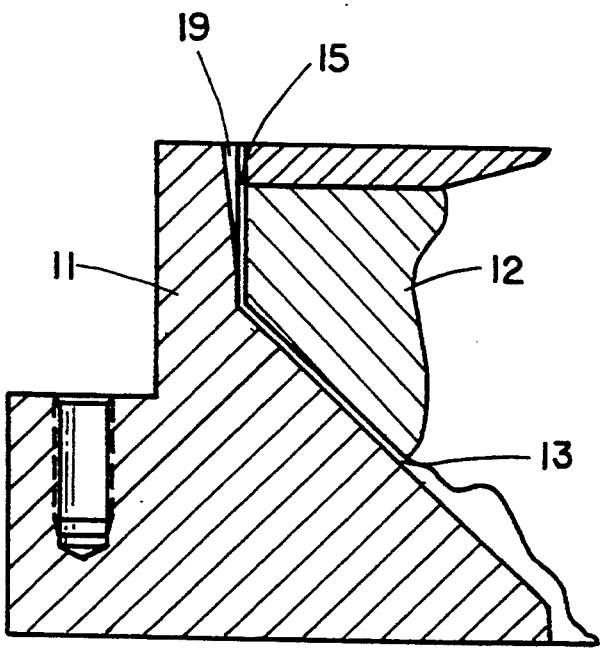
FIG. 8 shows a further tool in the case of which the projections are molded on through feed ducts without any auxiliary extruder.

FIG. 8 shows another tool without any auxiliary extruder. This tool as well consists of an outer ring 11 and a core 12 arranged therein so as to delimit the annular duct 13 between them, through which the plastic material flows to the tubular die 15. Additional material is fed through a duct 19 on the cylindrical part of the ring 11 so that the desired projection is produced. One duct 19 is provided for each projection. Depending on the depth and length of the duct 19, the projection will be larger or smaller; it may thus be made with the desired structure.

In addition to the projections 8 and 9, respectively, it is also possible to provide further projections which point in the same direction as the respectively associated section part. Although not specifically illustrated in the figures, it will be understood that such projections may be placed at the same position as the associated outwardly directed projections 8 and 9. It is also possible, however, to arrange spaced inwardly pointing projections spaced from the outwardly directed ones 8 and 9. These additional inwardly directed projections serve to provide an additional stiffening effect.

The working embodiment shown in FIG. 4 with four projections 8 on the film 3 of the male section 1 and with two projections 9 on the film 4 of the female section 2 is particularly suitable in the section illustrated in FIG. 4, which is in accordance with the aforesaid European patent publication 223,125 A. In this case the back of the male section and also the back of the female section is so thin that there is no stabilizing effect. The stabilization is, provided according to the invention by the projections 8 and 9.

What is claimed is:

1. A closure device for storage bags and the like, comprising a male section and a female section which are connected to a film-like member which forms the bag and are adapted to be detachably connected with each other, said male section of said closure device including at least two continuous projections on its side facing away from said female section, said projections projecting above said film-like member and being spaced apart to form a depression extending between said projections so that a user's finger or thumb can be run across the film-like member between said projections to guide the closing action of said closure device, wherein at least a portion of said film-like member between said projections is of a thickness equal to that of said film-like member forming the bag.

2. The closure device as claimed in claim 1, wherein two said spaced-apart continuous projections are provided.

3. The closure device as claimed in claim 1, wherein four said spaced-apart continuous projections are provided.

4. The closure device as claimed in claim 1, wherein at least two continuous projections are also provided on the female section on its side facing away from said male section said projections projecting above said film-like member and being spaced apart to form a depression extending between said projections so that a user's finger or thumb can be run across the film-like member between said projections to guide the closing action of said closure device.

5. The closure device as claimed in claim 4, wherein at least one projection is colored.

6. The closure device as claimed in claim 1, wherein at least one projection is colored.

7. A closure device according to claim 1, wherein both said closure device and the bag are made of plastic.

8. A bag and closure device according to claim 7, wherein said bag and closure device are formed integrally with each other.

9. A closure device for storage bags and the like, comprising a male section and a female section which are connected to a film-like member which forms the bag and are adapted to be detachably connected with each other, said male section of said closure device including at least two continuous projections on its side facing away from said female section, said projections projecting above said film-like member and being spaced apart to form a depression extending between said projections so that a user's finger or thumb can be run across the film-like member between said projections to guide the closing action of said closure device, wherein no portion of said film-like member between said projections extends above said projections.

10. The closure device as claimed in claim 9, wherein two said continuous projections are provided.

11. The closure device as claimed in claim 9, wherein four said continuous projections are provided.

12. The closure device as claimed in claim 9, wherein at least two spaced-apart continuous projections are also provided on the female section on its side facing away from said male section.

13. The closure device as claimed in claim 12, wherein at least one projection is colored.

14. The closure device as claimed in claim 9, wherein at least one projection is colored.

15. The closure device as claimed in claim 9, wherein both said closure device and the bag are made of plastic.

16. A bag and closure device according to claim 15, wherein said bag and closure device are formed integrally with each other.

* * * * *